US006171448B1

(12) United States Patent
Iwashige

(10) Patent No.: US 6,171,448 B1
(45) Date of Patent: Jan. 9, 2001

(54) APPARATUS FOR SCREENING WASTE PAPER PULP

(75) Inventor: Naoyuki Iwashige, Kooriyama (JP)

(73) Assignees: Ishikawajima-Harima Jukogyo Kabushiki Kaisha; Ishikawajima Sangyo Kikai Kabushiki Kaisha, both of Tokyo-to (JP)

( * ) Notice: Under 35 U.S.C. 154(b), the term of this patent shall be extended for 0 days.

(21) Appl. No.: 09/238,640

(22) Filed: Jan. 28, 1999

(30) Foreign Application Priority Data

Feb. 3, 1998 (JP) ..... 10-022008

(51) Int. Cl.[7] ..... D21B 1/08; D21D 5/02

(52) U.S. Cl. ..... 162/380; 162/55; 209/240; 209/270; 209/306; 210/415; 210/413

(58) Field of Search ..... 162/380, 234, 162/55, 57–58, 268; 241/46.02, 61, 80–81, 20, 21, 24, 76; 209/10, 240, 268, 300, 305–206, 270, 273; 210/415, 413

(56) References Cited

U.S. PATENT DOCUMENTS

| | | | |
|---|---|---|---|
| 3,411,721 | 11/1968 | Delcellier | 241/97 |
| 3,726,401 | 4/1973 | Bolton, III et al. | 209/240 |
| 5,061,370 | 10/1991 | Ferland et al. | 210/194 |
| 5,564,572 | 10/1996 | Iwashige et al. | 209/10 |
| 5,597,075 | 1/1997 | Iwashige et al. | 209/10 |
| 5,601,690 * | 2/1997 | Gauld et al. | 162/55 |
| 5,798,025 | 8/1998 | Iwashige et al. | 162/261 |
| 5,967,335 * | 10/1999 | Clarstrom et al. | 209/389 |
| 6,029,825 * | 2/2000 | Pfeffer et al. | 210/414 |

FOREIGN PATENT DOCUMENTS

| | | |
|---|---|---|
| 0 355 530 | 2/1990 | (EP) . |
| 0 649 940 | 4/1995 | (EP) . |
| WO 95/06159 | 3/1995 | (WO) . |

* cited by examiner

*Primary Examiner*—Stanley S. Silverman
*Assistant Examiner*—Jose' A. Fortuna
(74) *Attorney, Agent, or Firm*—Oblon, Spivak, McClelland, Maier & Neustadt, P.C.

(57) ABSTRACT

A casing has a pulp slurry inlet, a reject outlet and an accept stock outlet and accommodates a rotor. The rotor has a hollow cylinder with scraper blades at its outer periphery. A screen plate is disposed outside of the scraper blades to provide between them a passage facing to the screen plate. The hollow cylinder is formed with pulp slurry outlets. Rotation of the hollow cylinder causes the pulp slurry to be circulated outside and inside of the hollow cylinder, so that separation of the pulp slurry into accept stock and reject is repeatedly carried out by the screen plate.

4 Claims, 8 Drawing Sheets

APPARATUS FOR SCREENING WASTE PAPER PULP

BACKGROUND OF THE INVENTION

The present invention relates to a method and an apparatus for screening waste paper pulp to separate contaminants from paper stock in the field of industries using waste paper pulp as stock such as paper pulp and fiberboard industries.

In such industries, utilization of waste paper as paper stock will inevitably involve separation and removal of various contaminants such as plastics, vinyl strings and binding gum on magazines, which contaminants are intermingled during recovery of waste paper.

In general, contaminants which are larger in size than and/or much different in shape from pulp fiber are removed by an apparatus called screen.

Widely used as the screening apparatus is a closed pressurized one that accommodates a strainer with a number of pores. Efficiency or ratio of removing contaminants in the screen is closely related with reject ratio (quantitative ratio of the stock not passing through the strainer to the whole stock at entry) of the screen.

As shown in FIG. 1, increase and decrease of reject ratio lead to enhancement and lowering of contaminant removal ratio, respectively.

Attempt to reduce the reject ratio in an ordinary screen will tend to cause plugging of the screen plate or of a reject valve due to increased reject consistency. Even if such plugging may be averted, extreme reduction of the reject ratio would worsen the effect of removing contaminants, failing to obtain sufficient screening effect.

Increase of the reject ratio to a certain extent is therefore required for obtaining pulp with less quantity of contaminants. However, increase of the reject ratio means reduction of yield of paper stock.

Generally, in order to overcome this problem in a screening apparatus, a reject ratio of 20 to 25% is selected, over which the curve shown in FIG. 1 becomes dull and the contaminant removal ratio is less affected; and the reject is re-processed by a so-called "multiple cascade flow" system to reduce the reject ratio in the whole of the system.

Pulp slurry sent to the screening process includes a large quantity of undefibered stock, which is larger in size than and/or different in shape from pulp fiber and exhibits behavior similar to that of the contaminants in the screening apparatus.

The yield of paper stock cannot be improved if such undefibered stock is separated and removed since the undefibered stock may become stock of very good quality when defibered.

For this reason, generally a screening system has a defibrator to defiber such undefibered stock. The defibrator is often incorporated in the reject line of the screening system for efficient defibration.

FIG. 2 shows a cascade flow system most commonly used.

In general, a screening system utilizing multiple cascade flow is composed of a coarse screening stage I for removing relatively coarse contaminants and a fine screening stage II for removing finer contaminants.

In the coarse screening stage I, the reject from a primary screen a is defibered in a defiberator h and is then processed by a secondary screen b; and the accept stock in the secondary screen is joined with the accepted stock from the primary screen a and is fed to the fine screening stage II. The reject from the second screen b is processed by a tertiary screen c and the accept stock from the tertiary screen is returned to the secondary screen b. Only the reject from the tertiary screen c is discharged out of the system.

In the fine screening stage II, the accept stock from the coarse screening stage I is processed by the primary screen d and the reject from the primary screen is processed by a secondary screen e. The accept stock from the secondary screen is joined with the accept stock from the primary screen d and is discharged as the stock accepted in the system. The reject from the secondary screen e is defibered in a defiberator i and is then processed by a tertiary screen f. The accept stock from the tertiary screen is returned to the secondary screen e. The reject from the tertiary screen f is processed by a quaternary screen g. The stock accepted at the quaternary screen is returned to the tertiary screen f and only the reject from the quaternary screen g is discharged out of the system.

As is clear from the above, the more the number of the screens with the cascade process is increased, the more the degree of screening and production yield can be enhanced, but disadvantageously the more the scale and cost of the facilities increase and the higher the power required to operate the screening system is.

BRIEF SUMMARY OF THE INVENTION

It is therefore an object of the present invention to provide a method and an apparatus for screening waste paper pulp in which final screening is improved in removal of contaminants to thereby decrease the number of screens in the screening system as a whole.

Preferred embodiments of the invention will be described in conjunction with the attached drawings.

DETAILED DESCRIPTION OF THE PREFERRED EMBODIMENTS

Figure 1:
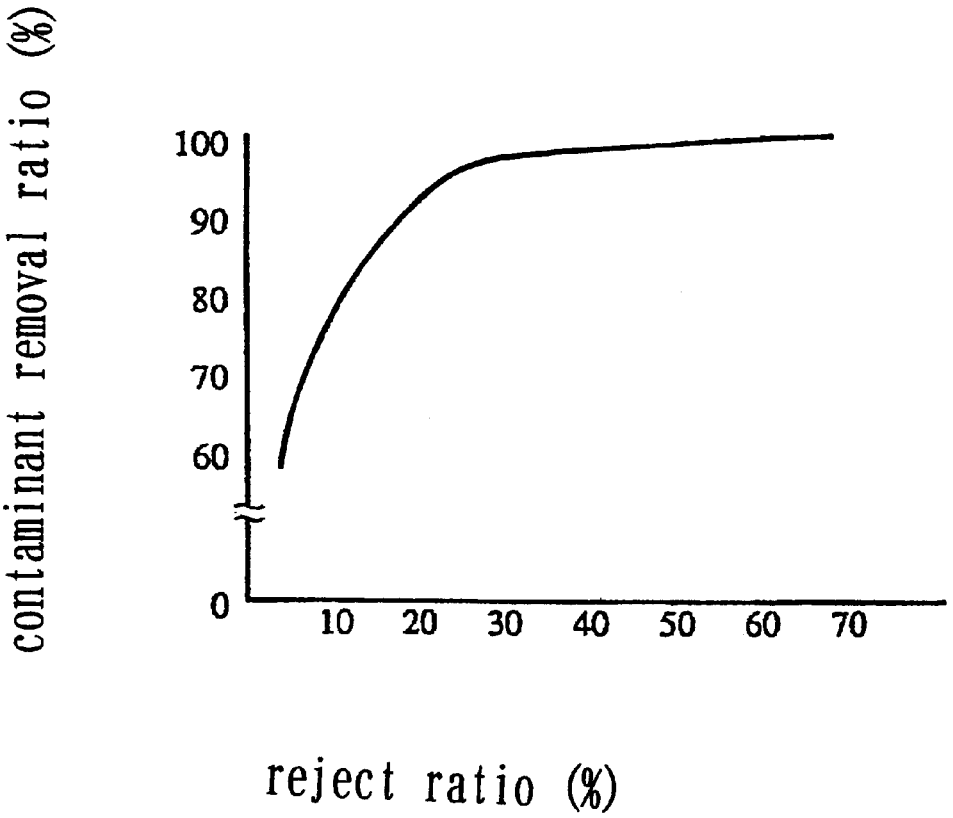
FIG. 1 PRIOR ART
FIG. 1 is a diagram showing a relationship between reject ratio and contaminant removal ratio in a conventional screen.
Figure 2:
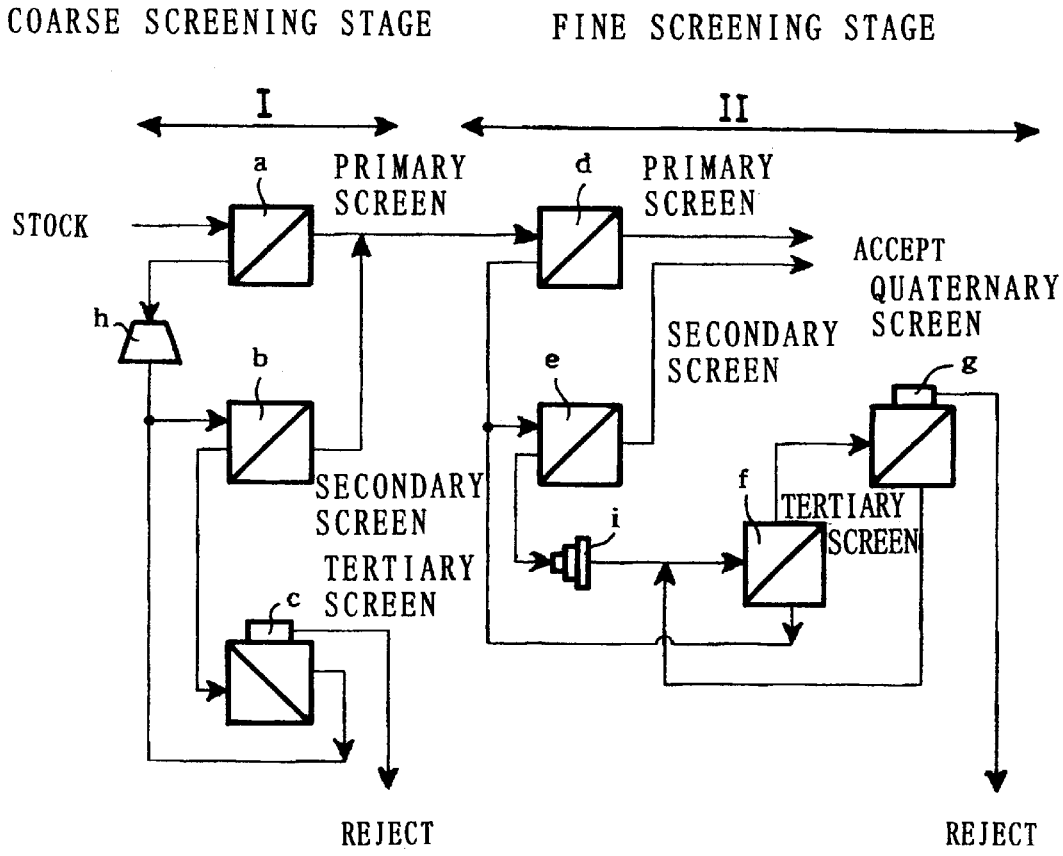
FIG. 2 PRIOR ART
FIG. 2 is a flow sheet of a conventional screening process.
Figure 3:
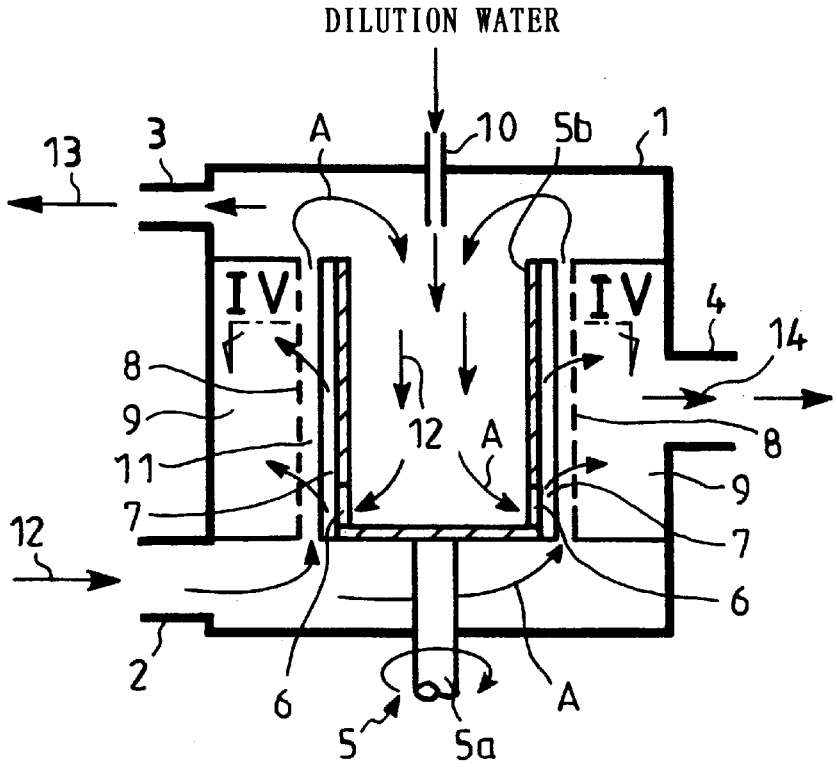
FIG. 3 is a vertical sectional view schematically showing a screening apparatus according to a first embodiment of the invention.
Figure 4:
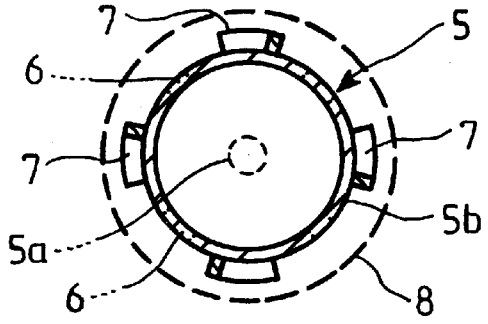
FIG. 4 is a view looking in the direction of arrows IV—IV in FIG. 3.

FIGS. 3 and 4 schematically illustrate an apparatus for screening waste paper pulp according to a first embodiment of the invention which comprises a casing 1 with a pulp slurry inlet 2, a reject outlet 3 and an accept stock outlet 4 at lower left, upper left and middle right in FIG. 3, respectively. The casing 1 accommodates a rotor 5 driven by a drive unit (not shown).

The rotor 5 comprises a drive-force transmitting shaft 5*a* and a hollow cylinder 5*b* integral at its closed bottom with an end of the shaft 5*a*. The cylinder 5*b* has an axial length substantially equal to a distance between the inlet 2 and the outlet 3. The cylinder 5*b* has an open end closer to the outlet 3 as well as the closed end or bottom closer to the inlet 2. The cylinder 5*b* has, at its outer periphery closer to the closed bottom, pulp-slurry discharge ports 6 peripherally spaced apart from each other. The cylinder 5*b* further has, at its outer periphery, scraper blades 7 (pulp-slurry moving means) twisted and peripherally spaced apart from each other to move the pulp slurry 12 in the direction of an arrow A as the rotor 5 is rotated.

The casing 1 is formed with a ring-like screen cylinder 9 with a screen plate 8 facing at a predetermined spacing to the scraper blades 7 and communicated with the accept stock outlet 4. The casing 1 is further formed with a dilution-water injection port 10 facing to the open end of the cylinder 5*b*. Space between the scraper blades 7 and the screen plate 8 provides a screen plate facing passage 11 (i.e., the passage facing to the screen plate) for circulation of the pulp slurry 12.

In the arrangement as described above, the pulp slurry 12 supplied through the inlet 2 is circulated inside the casing 1. Repeated movement of the pulp slurry 12 over the surface of the screen plate 8 causes the slurry to be separated into accept stock 14 and reject 13.

More specifically, the pulp slurry 12 supplied to the casing 1 is pushed (upwardly in FIG. 3) in the passage 11, i.e. the space between the scraper blades 7 and the screen plate 8, to the reject outlet 3 by feed action in the direction of the arrow A generated by the twisted scraper blades 7 of the rotating rotor 5.

In this process, some of the pulp slurry 12 passes or is screened through the screen plate 8 into the screen cylinder 9 and is withdrawn as accept stock 14 through the accept stock outlet 4. The remaining pulp slurry 12 is sent into the cylinder 5*b* through the upper open end of the latter, mixed with dilution water and moved downward in the figure. Then, the pulp slurry 12 is discharged through the pulp-slurry discharge ports 6 and is forced to move by the scraper blades 7 again as described above.

Such circulation of the pulp slurry 12 inside and outside of the hollow cylinder 5*b* and repeated movement of the slurry 12 over the surface of the screen plate 8 cause the slurry 12 to be separated into the accept stock 14 and the reject 13 at higher efficiency.

Figure 5:
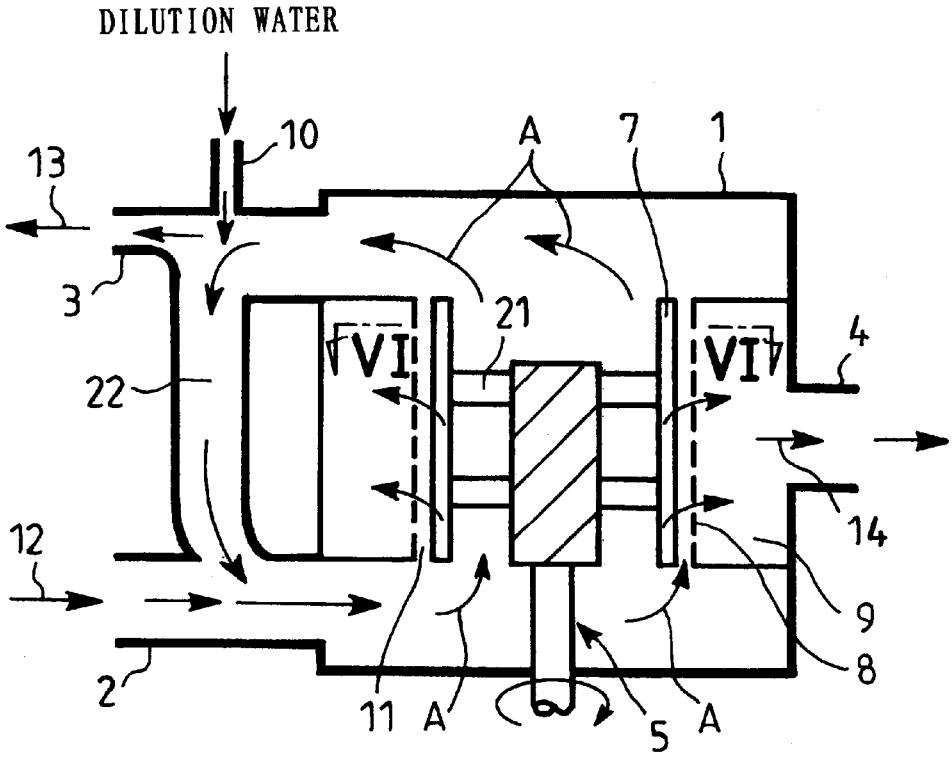
FIG. 5 is a vertical sectional view schematically showing a screening apparatus according to a second embodiment of the invention.
Figure 6:
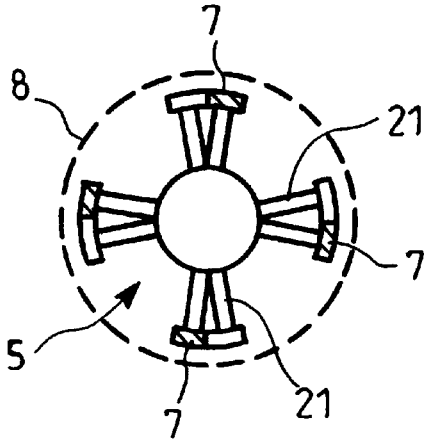
FIG. 6 is a view looking in the direction of arrows VI—VI in FIG. 5.

FIGS. 5 and 6 schematically illustrate a screening apparatus according to a second embodiment of the invention. Components similar in function or effect to those in the first embodiment shown in FIG. 3 are referred to by the same reference numerals. This also applies to FIGS. 7–11 to be described later.

The screening apparatus has, for example, four scraper blades 7 mounted via arms 21 on the rotor 5 inside the screen plate 8 and angularly spaced apart from each other by 90 degrees as shown in FIG. 6; alternatively, the scraper blades 7 may be of the type which are formed on a drum such as the hollow cylinder 5*b* as shown in FIGS. 3 and 4. A circulation passage 22 for connecting the pulp slurry inlet 2 with the reject outlet 3 is formed outside of the screen cylinder 9 in the casing 1. The dilution-water injection port 10 shown is positioned above the circulation passage 22; alternatively, it may be provided in a reject zone located from above the rotor 5 to the circulation passage 22 in the casing 1.

In the arrangement as described above, the pulp slurry 12 supplied to the casing 1 is forced to move by the scraper blades 7 of the rotating rotor 5 so that it is moved upward through the screen plate facing passage 11 as shown by the arrow A. During this process, some of the pulp slurry 12 passes through the screen plate 8 into the screen cylinder 9 and is withdrawn as accept stock 14 through the accept stock outlet 4. The remaining pulp slurry 12 is mixed with dilution water and is moved downward through the circulation passage 22. Then, it is sent together with new pulp slurry 12 coming from the inlet 2 to the passage 11 and is forced to move upward by the scraper blades 7 as already described.

In this way, the pulp slurry 12 is circulated through the passages 11 and 22 and upper and lower horizontal passages which connect these two passages and is repeatedly moved over the surface of the screen plate 8. As a result, separation of the pulp slurry 12 into the accept stock 14 and the reject 13 can be carried out with higher efficiency.

Figure 7:
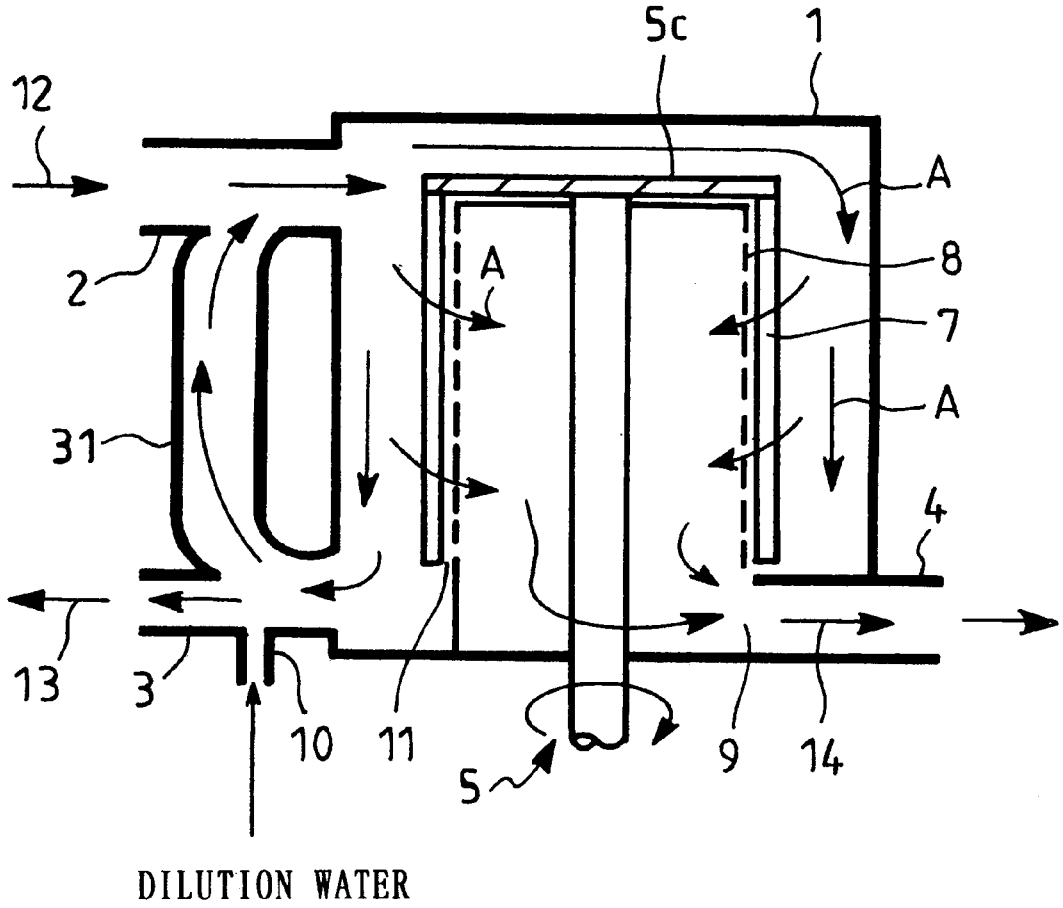
FIG. 7 is a vertical sectional view schematically showing a screening apparatus according to a third embodiment of the invention.

FIG. 7 schematically illustrates a screening apparatus according to a third embodiment of the invention.

In this screening apparatus, the pulp slurry inlet 2 is positioned above and the reject outlet 3 is provided below. The accept stock outlet 4 is also provided below at a position opposite to the reject outlet 3.

The rotor 5 has an upper portion in the form of a disk 5*c*. The scraper blades 7 same as those shown in FIG. 6 are mounted on the disk 5*c*. The screen cylinder 9 with the screen plate 8 is provided inside the scraper blades 7 to provide the screen-plate facing passage 11. A circulation passage 31 is provided between the pulp slurry inlet 2 and the reject outlet 3 and the dilution-water injection port 10 is formed under the passage 31.

In the arrangement as described above, the pulp slurry 12 supplied to the casing 1 is subject to the action of the scraper blades 7 rotating together with the rotor 5 and is circulated through the screen plate facing passage 11 and the circulation passage 31 as shown by the arrow A. During this circulation process, the pulp slurry 12 is repeatedly moved over the surface of the screen plate 8 so that separation of the pulp slurry 12 into the accept stock 14 and the reject 13 can be carried out with high efficiency.

FIGS. 8–11 illustrate a further embodiment of the screening apparatus, which is provided with dehydrating means for the reject.

This screening apparatus is similar to the screening apparatuses as shown in FIGS. 3 to 7 except that a dehydrating mechanism for reject 13 is provided inside a rotor 5.

Figure 10:
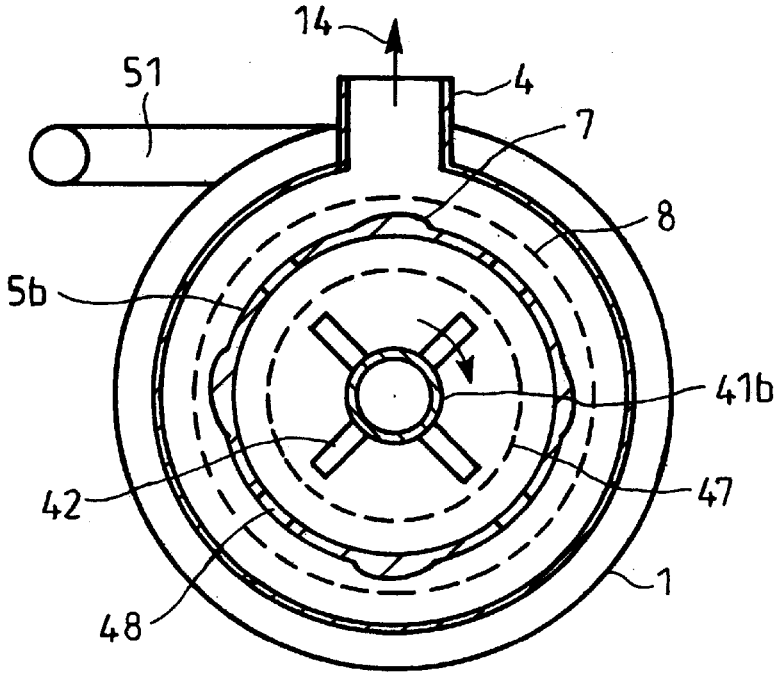
FIG. 10 is a view looking in the direction X in FIG. 8.
Figure 11:
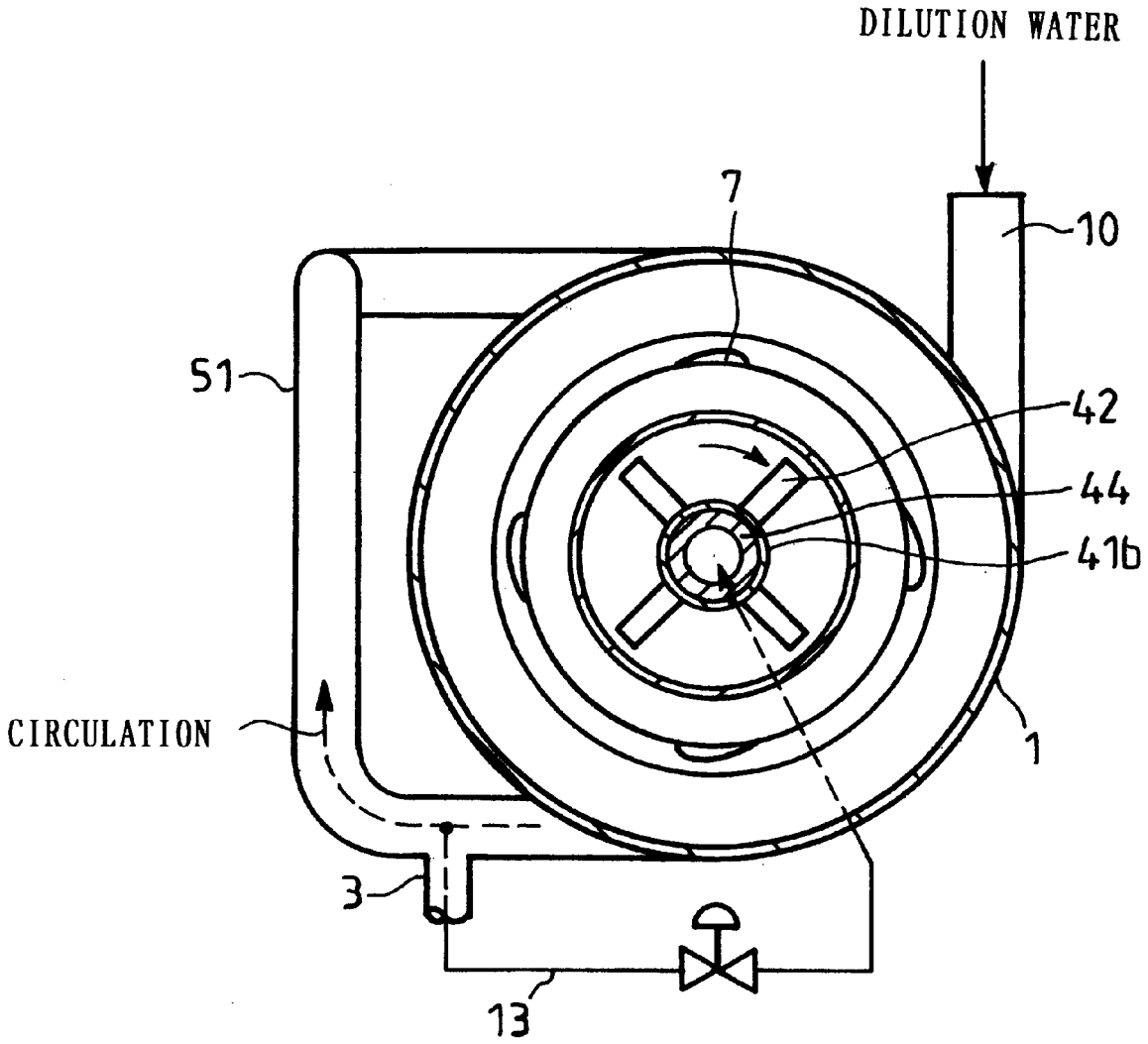
FIG. 11 is a view looking in the direction XI in FIG. 8.

More specifically, the casing 1 accommodates the rotor 5 comprising a hollow shaft 5*a*' and a hollow cylinder 5*b*. The cylinder 5*b* has convex scraper blades 7 mounted on an outer periphery of the cylinder 5*b* as shown in FIG. 10. The casing 1 has a pulp slurry inlet 2, a reject outlet 3, an accept stock outlet 4 and a dilution-water injection port 10. The casing 1 further has a screen cylinder 9 with a screen plate 8 at a position opposite to the scraper blades 7 so that the screen-plate facing passage 11 is formed between them. The screen cylinder 9 is communicated with the accept stock outlet 4.

A rotation shaft 41*a* and a hollow pipe 41*b* integral with the shaft 41*a* are fitted in the hollow shaft 5*a*' and the hollow cylinder 5*b*, respectively, to provide a dehydrating rotor 41 inside the rotor 5.

The pipe 42 has discharge paddles 42 mounted on an outer periphery of the pipe 42 and axially spaced apart from each other so as to discharge solid contaminants in the reject 13 outside. The pipe 41*b* is formed with reject outlets 43 closer to its one end (left in FIG. 8) adjacent to the shaft 41*a* as well as a reject inlet 44 at its other end away from the shaft 41*a*. The reject inlet 44 is communicated with the reject outlet 3 of the casing 1.

The hollow cylinder 5*b* accommodates a mesh-like dehydrating basket 47 facing to and surrounding the discharge paddles 42. A wall portion of the hollow cylinder 5*b* which encasing the basket 47 is tapered and formed with dehydration outlets 48 which in turn face to the screen plate 8 and are communicated with inside of the casing 1. The hollow cylinder 5*b* has at its free end (right in FIG. 8) a contaminant discharge duct 46 integral with the reject inlet 44 for discharge of solid contaminants 45.

Figure 8:
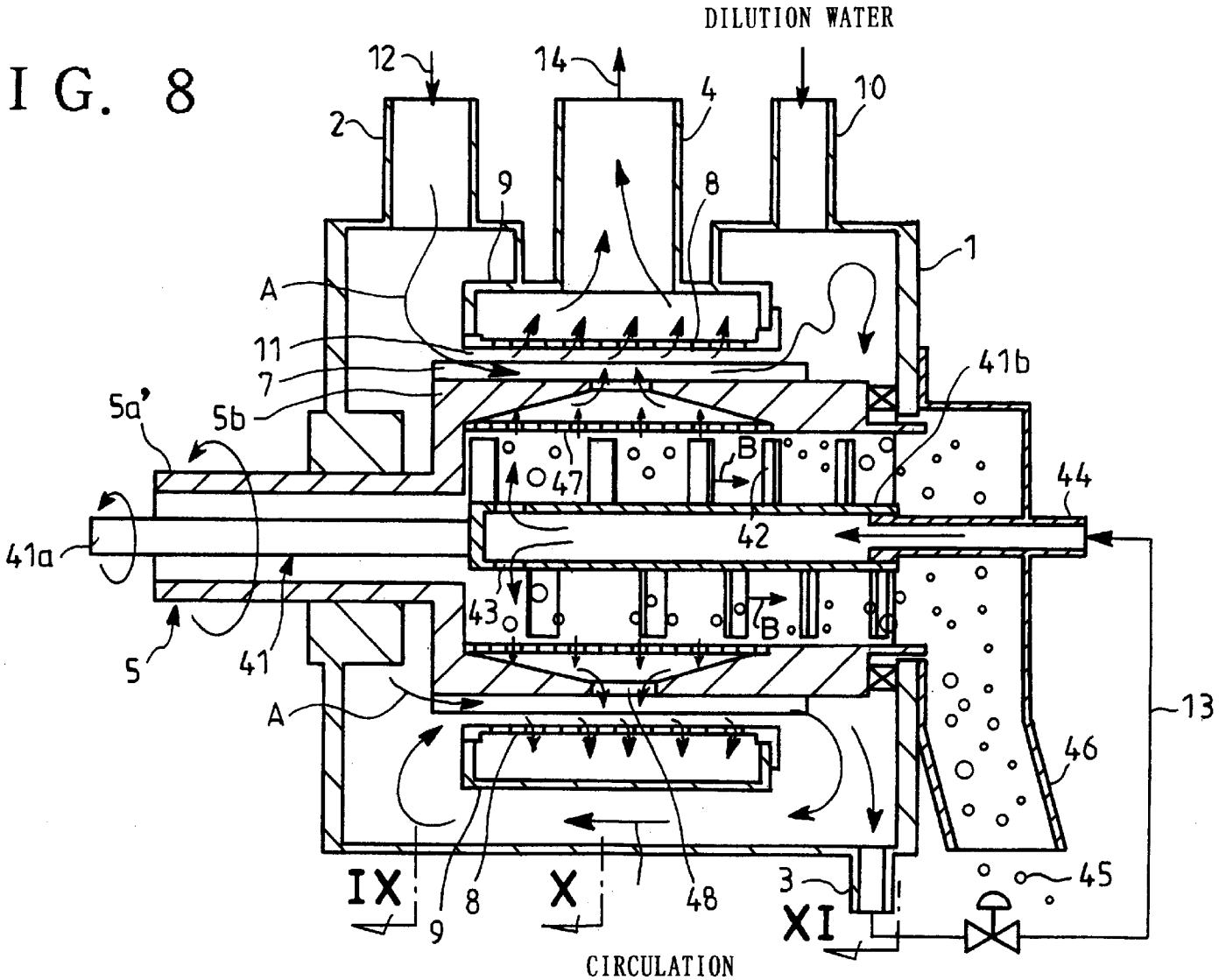
FIG. 8 is a vertical sectional view showing a further embodiment of a screening apparatus capable of dehydrating the rejects.
Figure 9:
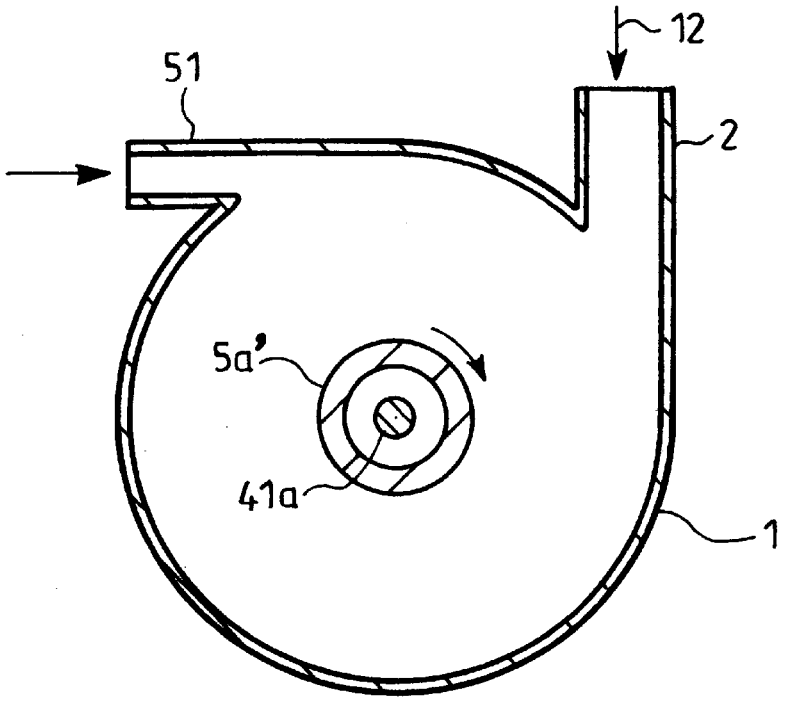
FIG. 9 is a view looking in the direction IX in FIG. 8.

The discharge paddles 42 are mounted on the pipe 41*b* at such angles that the reject 13 introduced through the inlet 44 into the pipe 41*b* and discharged out of the pipe 41*b* into inside of the cylinder 5*b* is pushed in the direction of arrows B toward the contaminant discharge outlet 46 (right in FIG. 8). Shown in FIG. 8 is an example in which the respective paddles 42 have feed angles gradually increased toward a last stage of discharging the solid contaminants 45 so that the velocity of the reject 13 moved is initially high and is gradually lowered.

The discharge paddles 42 can be rotated relatively to the dehydrating basket 47 by rotating the shaft 5*a*' and 41*a* at mutually different angular velocities. This causes the reject 13 to pass on the surface of the dehydrating basket 47 while water in the reject 13 is subjected to centrifugal effect so that the reject 13 is gradually dehydrated and the removed water is discharged through the dehydration discharge ports 48 to inside of the casing 1. The resultant solid contaminants 45 are discharged through the contaminant discharge duct 46.

The reject 13 at the reject outlet 3 shown at lower right in FIG. 8 is partly returned through a circulation pipe 51 (circulation passage) to inside of the casing 1 adjacent to the pulp slurry inlet 2 at upper left in FIG. 8 for circulation.

Next, mode of operation of the screening apparatus shown in FIG. 8 will be described.

The fact that the pulp slurry 12 is highly efficiently separated into the reject 13 and the accept stock 14 through repeated movement of the slurry 12 over the surface of the screen plate 8 during circulation of the slurry 12 has been explained with respect to the embodiments shown in FIGS. 3–7. Accordingly, the description is given here on the mode of operation of the dehydrating means and mainly on the hollow cylinder 5*b* for applying centrifugal force to the slurry 12 to dehydrate the slurry 12 as well as on the dehydrating rotor 41 rotated relative to the cylinder 5*b*.

The pulp slurry 12 with the accept stock 14 being separated, i.e., the reject 13 is discharged through the reject outlet 3 and is partly circulated through the circulation pipe 51 toward the pulp slurry inlet 2 as mentioned above. The remaining of the reject 13 is introduced through the reject inlet 44 into the hollow pipe 41*b* of the dehydrating rotor 41 and is discharged through the reject discharge ports 43 into inside of the hollow cylinder 5*b*. Then, the reject 13 is moved with gradually slowed velocity toward right in FIG. 8 by the discharge paddles 42 so that the reject 13 is dehydrated with the removed water being discharged through the dehydrating basket 47.

Generally speaking, it is relatively easy to dehydrate slurry having higher moisture content to some extent whereas further dehydration of the slurry which has been dehydrated to some extent is difficult to carry out. This problem is overcome by the invention. During initial stage of dehydration, i.e., in dehydration of the reject 13 just after its discharge through the ports 43 and having higher moisture content, the reject 13 is moved at relatively higher velocity by the discharge paddles 42 installed at smaller tilt angles so that thick stock mat is prevented from being formed on the dehydrating basket 47 so as to prevent rotation of the paddles 42 and the basket 47 in unison. In late stage of dehydration process, the reject 13 is moved at slower velocity by the discharge paddles 42 installed at larger tilt angles and the stock mat formed on the basket 47 is scraped off by the discharge paddles 42 into flakes and is fluidized; and dehydration is performed slowly. As a result, effective dehydration can be carried out over the entire area of the dehydrating basket 47. The contaminants 45 in form of flakes are finally discharged outside through the duct 46.

On the other hand, the removed water from the reject 13 is sent or withdrawn through the ports 48 of the cylinder 5*b* to inside of the casing 1 and is used to dilute the pulp slurry 12 in cooperation with the dilution water injected through the port 10.

Thus, according to the screening apparatus shown in FIG. 8, the pulp slurry 12 is circulated in the casing 1 and is separated into the accept stock 14 and the reject 13, the latter being dehydrated by the internal dehydrating means. As a result, the solid contaminants 45 can be withdrawn, which fact facilitates post-processing of the contaminants.

As described above, according to the invention, the pulp slurry is circulated and is repeatedly moved over the surface of the screen plate constituting a part of the circulation passage so that the accept stock is withdrawn in each of the cycles. As a result, the pulp slurry can be separated into the accept stock and the reject with higher efficiency. Moreover, the pulp slurry is separated into the accept stock and the reject and the latter is dehydrated by the internal dehydrating means during circulation of the pulp in the casing so that, finally, solid contaminants can be withdrawn, which fact facilitates post-processing of the contaminants.

What is claimed is:

1. An apparatus for screening waste paper pulp wherein pulp slurry of waste paper pulp is introduced into a casing and is forced to move over a surface of a screen plate installed in the casing so as to screen and classify the pulp slurry into accept stock passing through the screen plate as well as reject not passing through the screen plate, said casing having a pulp slurry inlet, an accept stock outlet and a reject outlet, said apparatus including in the casing:

a screen cylinder with the screen plate and communicated with said accept stock outlet;

pulp slurry moving means for moving said pulp slurry over the surface of said screen plate; and dehydrating means inside of the pulp slurry moving means and comprising a rotatable hollow shaft for receiving the reject from said reject outlet through a circulation pipe, a rotatable hollow cylinder having a mesh-like dehydrating basket for receiving the reject discharged outwardly through said hollow shaft and discharge paddles mounted on said hollow shaft for axially moving contaminants on the dehydrating basket, whereby the contaminants in solid state dehydrated through said dehydrating basket are discharged outside by said discharge paddles.

2. An apparatus according to claim 1, wherein said pulp slurry moving means comprises scraper blades mounted on the hollow cylinder at positions opposite to the screen plate.

3. An apparatus for screening waste paper pulp, comprising:

a casing having a pulp slurry inlet through which pulp slurry of waste paper pulp is configured to be introduced into the casing;

a screen cylinder provided in the casing and having a screen plate which is configured to screen and classify the pulp slurry into accept stock passing through the screen plate as well as reject not passing through the screen plate;

an accept stock outlet for the accept stock, the accept stock outlet being communicated with the screen cylinder;

a reject outlet for the reject connected to the casing;

at least one blade configured to move the pulp slurry to a surface of the screen plate; and a dehydrator for the reject, the dehydrator being provided inside of the at least one blade and comprising:

a rotatable hollow shaft configured to receive the reject from said reject outlet;

a rotatable hollow cylinder having a meshed dehydrating basket to receive the reject discharged outwardly through said hollow shaft; and discharge paddles mounted on said hollow shaft for axially moving contaminants on the dehydrating basket, whereby the contaminants in solid state dehydrated through said dehydrating basket are discharged outside by said discharge paddles.

4. An apparatus according to claim 3, wherein the at least one blade is mounted on the hollow cylinder at a position opposite to the screen plate.

* * * * *